US012044074B2

(12) United States Patent
Kutbi et al.

(10) Patent No.: US 12,044,074 B2
(45) Date of Patent: Jul. 23, 2024

(54) ROLLING BLADE PDC BIT

(71) Applicant: SAUDI ARABIAN OIL COMPANY, Dhahran (SA)

(72) Inventors: Eyas M. Kutbi, Dhahran (SA); Hamza Fethiza Tedjani, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/066,951

(22) Filed: Dec. 15, 2022

(65) Prior Publication Data

US 2024/0200408 A1 Jun. 20, 2024

(51) Int. Cl.

| | |
|---|---|
| ***E21B 10/14*** | (2006.01) |
| ***E21B 10/12*** | (2006.01) |
| ***E21B 10/18*** | (2006.01) |
| ***E21B 10/52*** | (2006.01) |

(52) U.S. Cl.
CPC ..... *E21B 10/14* (2013.01); *E21B 10/12* (2013.01); *E21B 10/18* (2013.01); *E21B 10/52* (2013.01)

(58) Field of Classification Search
CPC ..... E21B 10/14; E21B 10/12; E21B 10/18; E21B 10/52
See application file for complete search history.

(56) References Cited

U.S. PATENT DOCUMENTS

| | | | | |
|---|---|---|---|---|
| 8,881,848 | B2 | 11/2014 | Knull et al. | |
| 9,556,681 | B2 | 1/2017 | Kulkarni | |
| 10,100,581 | B1 * | 10/2018 | Timte | E21B 10/52 |
| 2019/0003259 | A1 * | 1/2019 | Grosz | E21B 10/20 |
| 2020/0165876 | A1 * | 5/2020 | Dunbar | E21B 7/064 |
| 2020/0386056 | A1 * | 12/2020 | Grosz | E21B 10/20 |

* cited by examiner

*Primary Examiner* — Christopher J Sebesta
*Assistant Examiner* — Lamia Quaim
(74) *Attorney, Agent, or Firm* — Vorys, Sater, Seymour and Pease LLP

(57) ABSTRACT

A drill bit for forming a wellbore through a geologic formation includes a connector configured for connection to a drill string and a bit body coupled to the connector. A fixed cutting element is mounted on the bit body for rotation with the bit body and a slot extends through the bit body. A rolling cutting blade is supported in the slot such that an exposed segment of the cutting blade protrudes from slot and concealed segments of the rolling cutting blade adjacent the exposed segment are disposed within the slot. The rolling cutting blade rotates to thereby conceal the exposed segment and expose the concealed segments. A plurality of rotating cutting elements are supported on a periphery of the rolling cutting blade.

18 Claims, 3 Drawing Sheets

ROLLING BLADE PDC BIT

FIELD OF THE DISCLOSURE

The present disclosure relates generally to drill bits for forming wellbores through a geologic formation and, more particularly, to drill bits including both fixed and rotational cutting elements thereon.

BACKGROUND OF THE DISCLOSURE

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits with stationary cutting elements, or roller-cone drill bits with cutting elements mounted on one or more roller cones that are mounted for rotation with respect to a bit body of the drill bit. Fixed-cutter drill bits may be constructed with a plurality of hardened cutting elements fixed to a bit body made of metal or a matrix material. The fixed cutting elements may include, for example, Polycrystalline Diamond Compact (PDC) cutting elements, which generally operate to shear geologic material materials from the surrounding formation as the drill bit rotates within the wellbore. Roller-cone drill bits may be constructed of one or more roller cones rotatably mounted to the bit body, wherein the roller cones include the cutting elements thereon. The roller cones roll along the bottom of a wellbore as the roller-cone drills by crushing, gouging and/or scraping material from the geologic formation.

Hybrid drill bits have been developed with both fixed cutters and roller cones for various purposes. For example, a hybrid drill bit may be more durable, thereby permitting greater depths to be drilled before requiring maintenance or replacement of the drill bit than either a fixed-cutter drill bit or roller-cone drill bit alone. In some types of geologic formations. however, fixed cutting elements that shear geologic material from the surrounding formation may be preferred.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure a drill bit for forming a wellbore through a geologic formation includes a bit body that defines a bit body rotational axis extending longitudinally therethrough. A fixed cutting element is mounted on the bit body for rotation with the bit body about the bit body rotational axis. A slot extends through the bit body, and a rolling cutting blade is rotatably supported in the slot. An exposed segment of the rolling cutting blade protrudes from the slot and concealed segments of the rolling cutting blade adjacent the exposed segment are disposed within the slot. The rolling cutting blade is supported to rotate about a blade rotational axis to thereby conceal the exposed segment and expose the concealed segments. A plurality of rotating cutting elements are supported on a periphery of the rolling cutting blade.

According to another embodiment consistent with the present disclosure a downhole drilling system includes a drill string extending into a wellbore penetrating a geologic formation. A drill bit is coupled to the drill string and provides a bit body that defines a bit body rotational axis extending longitudinally therethrough. A slot extends through the bit body and a rolling cutting blade is supported in the slot such that an exposed segment of the rolling cutting blade protrudes from slot and concealed segments of the rolling cutting blade adjacent the exposed segment are disposed within the slot. The rolling cutting blade is supported to rotate about a blade rotational axis to thereby conceal the exposed segment and expose the concealed segments. A plurality of rotating cutting elements supported on a periphery of the rolling cutting blade.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
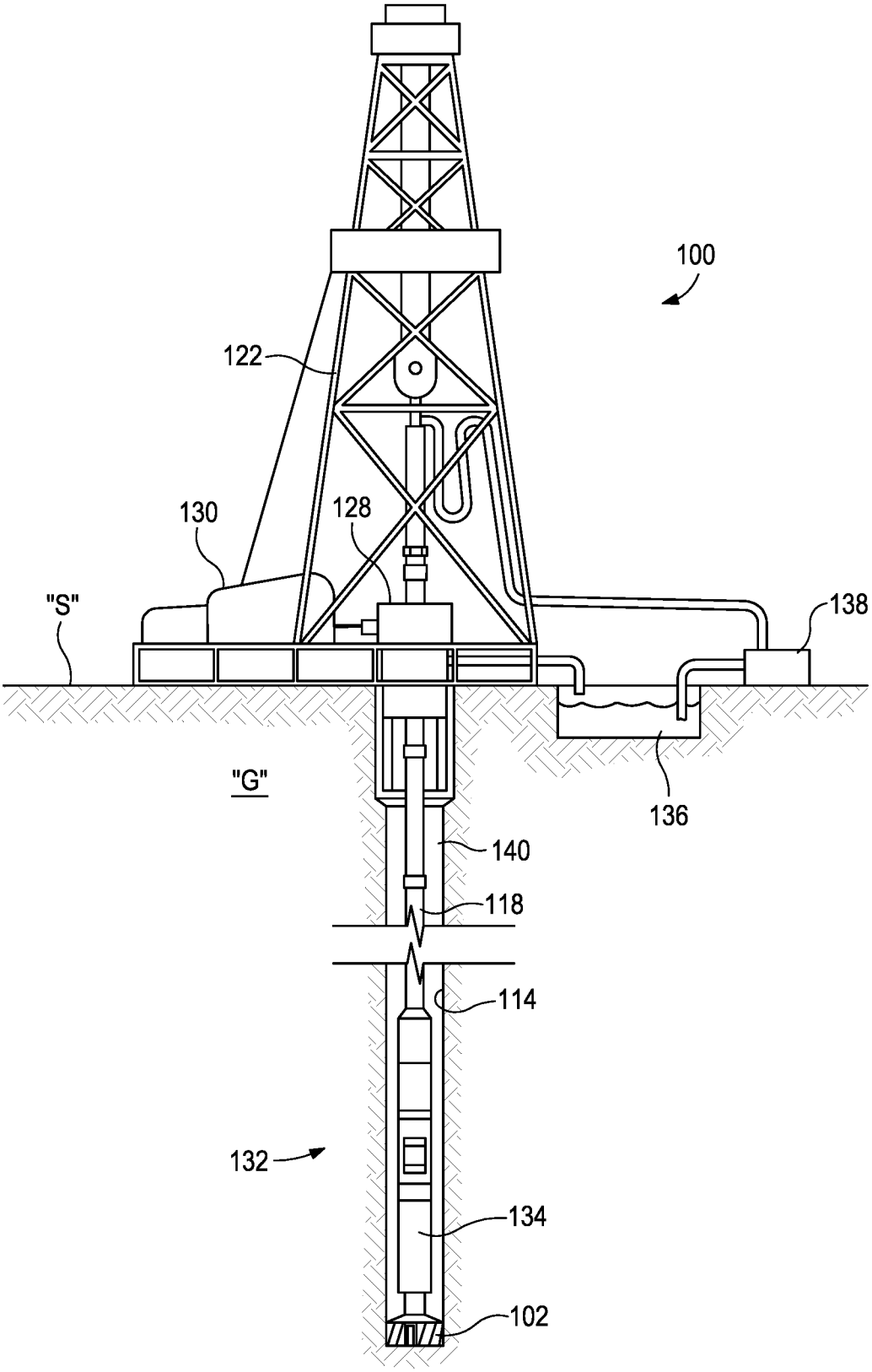
FIG. 1 is a partial cross-sectional side view of a drilling system including an example drill bit constructed in accordance with one or more exemplary embodiments of the disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a drill bit for use in drilling a wellbore through a subterranean geologic formation. A bit body supports fixed cutting elements thereon as well as at least one rotating blade with cutting elements disposed around a circumference of the rotating blade. The rotating blade may be supported within a slot defined in the bit body such that one or more of the cutting elements on the circumference are exposed to the geologic formation as the drill bit is rotated.

FIG. 1 illustrates an example of a drilling system 100 that may incorporate a hybrid drill bit 102 constructed in accordance with one or more exemplary embodiments of the disclosure. The drilling system 100 is partially disposed within a wellbore 114 extending from a surface location "S" and traversing a geologic formation "G." In the illustrated example, the wellbore 114 is shown generally vertical, though it will be understood that the wellbore 114 may include any of a wide variety of vertical, directional, deviated, slanted and/or horizontal portions therein, and may extend along any trajectory through the geologic formation "G."

The hybrid drill bit 102 is provided at a lower end of a drill string 118 for cutting into the geologic formation "G." When rotated, the hybrid drill bit 102 operates to break up and generally disintegrate the geological formation "G." The hybrid drill bit 102 may be rotated in any of a variety of ways. In this example, at the surface location "S" a drilling rig 122 includes a turntable 128 that may be operated to rotate the entire drill string 118 and the hybrid drill bit 102 coupled to the lower end of the drill string 118. The turntable 128 is selectively driven by an engine 130, chain-drive system, or other apparatus. In some embodiments, a bottom hole assembly or BHA 132 provided in the drill string 118 may include a downhole motor 134 to selectively rotate the hybrid drill bit 102 with respect to the rest of the drill string 118. The motor 134 may generate torque in response to the circulation of a drilling fluid, such as mud 136, therethrough. As those skilled in the art will recognize, the ability to selectively rotate the hybrid drill bit 102 relative to the drill string 118 may be useful in directional drilling, and/or for other operations as well.

The mud 136 can be pumped downhole by mud pump 138 through an interior of the drill string 118. The mud 136 passes through the downhole motor 134 of the BHA 132 where energy is extracted from the mud 136 to turn (rotate, operate, etc.) the hybrid drill bit 102. As the mud 136 passes through the BHA 132, the mud 136 may lubricate bearings (not explicitly shown) defined therein before being expelled through nozzles 224 (FIG. 2A) defined in the hybrid drill bit 102. The mud 136 flushes geologic cuttings and/or other debris from the path of the hybrid drill bit 102 as it continues to circulate back up through an annulus 140 defined between the drill string 118 and the geologic formation "G." The geologic cuttings and other debris are carried by the mud 136 to the surface location "S" where the cuttings and debris can be removed from the mud stream.

Figure 2B:
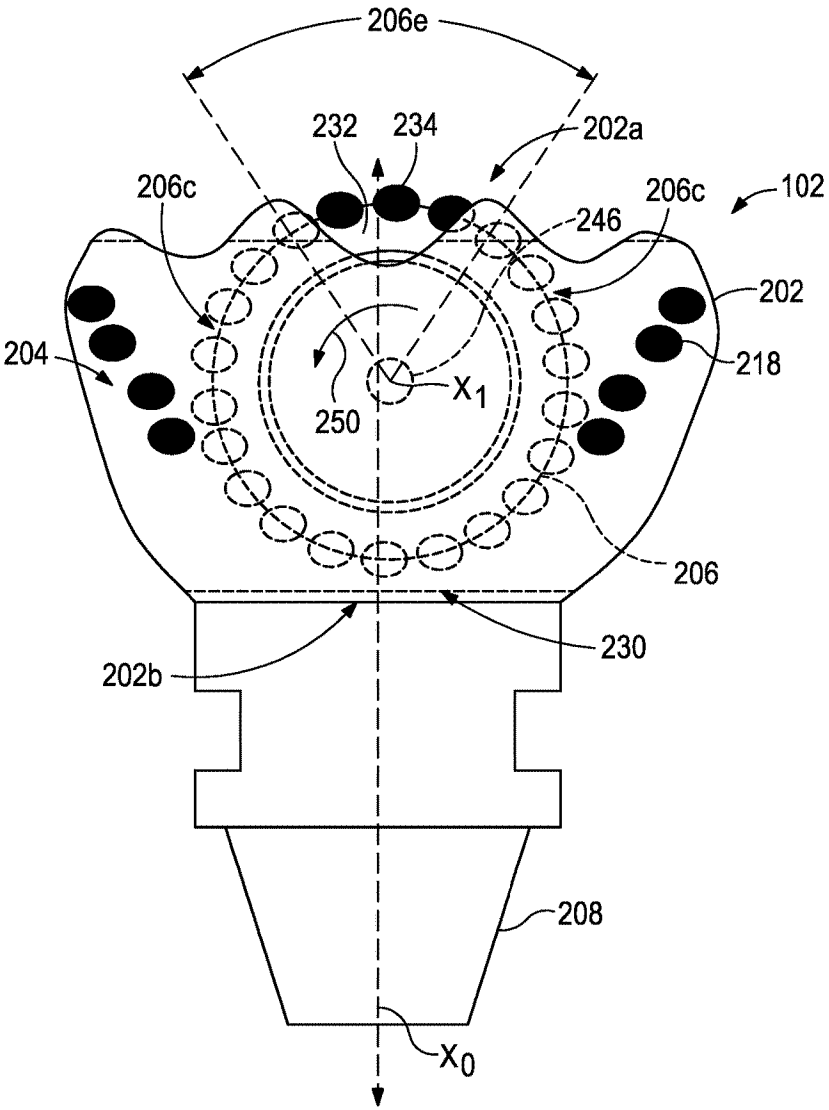
FIGS. 2A and 2B are enlarged side and front views, respectively, of the drill bit of FIG. 1 illustrating a rolling PDC blade protruding from a top side of a bit body that carries fixed PDC cutting elements thereon.
Figure 2A:
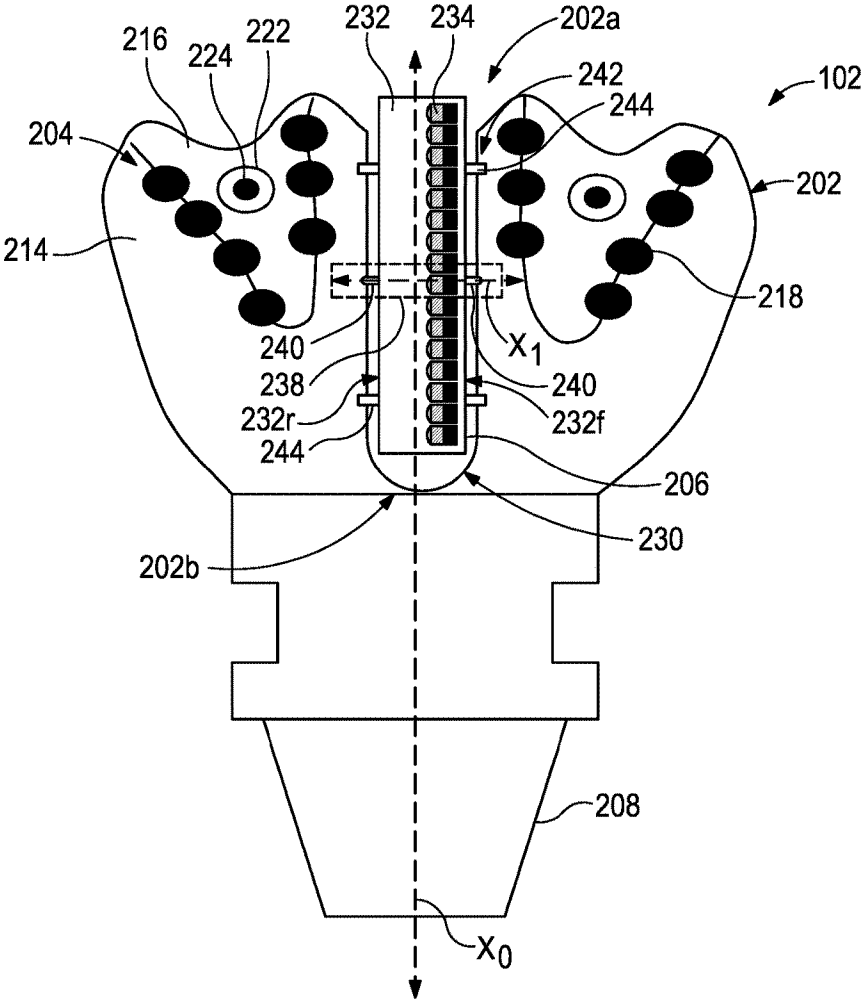

FIGS. 2A and 2B are side and front views, respectively, of an example of the hybrid drill bit 102, according to the principles of the present disclosure. The views shown in FIGS. 2A and 2B are 90° offset from each other. As illustrated, the hybrid drill bit 102 includes a bit body 202 defining a fixed cutting structure 204 and supporting a rolling cutting blade 206. Hybrid drill bit 102 may also include any of various types of connectors 208 extending from the bit body 202 for coupling the hybrid drill bit 102 to the drill string 118 (FIG. 1). In some exemplary embodiments, the connector 208 may include a threaded pin with American Petroleum Institute (API) threads, or other standard or non-standard threads defined thereon.

The bit body 202 defines a bit body rotational axis "$X_0$" extending between a leading end 202*a* and a trailing end 202*b* thereof. In some exemplary embodiments, the bit body 202 may be constructed of a metallic material such as steel or any of various metal alloys generally associated with manufacturing rotary drill bits. Alternatively, the bit body 202 may be constructed of matrix material formed by infiltrating a reinforcement material, e.g., tungsten carbide powder with a molten binder material, e.g., copper, tin, manganese nickel and zinc as appreciated by those skilled in the art.

The fixed cutting structure 204 includes a plurality of fixed cutting blades 214 circumferentially spaced about the bit body 202 with junk slots 216 defined between the fixed cutting blades 214. In some exemplary embodiments, cutting blades 214 are asymmetrically arranged about the bit body rotational axis "$X_0$." The junk slots 216 facilitate the removal of geologic materials and debris from the path of the hybrid drill bit 102, for example, by providing a flow path for drilling mud 136 (FIG. 1) around the bit body 202.

The fixed cutting blades 214 support a plurality of fixed cutting elements 218 thereon axially and radially spaced about bit body 202. As used herein, the term "fixed" in "fixed cutting elements" generally means that the cutting elements 218 are mounted for maintaining a position and orientation with respect to the bit body 202 as the hybrid drill bit 102 is rotated about the bit body rotational axis "$X_0$." In some embodiments, the fixed cutting elements 218 may be securely mounted to the fixed cutting blades 214 by brazing or other manufacturing techniques recognized in the art. The fixed cutting elements 218 engage and remove adjacent portions of the geologic formation "G" (FIG. 1), generally by shearing the geologic materials from the bottom and sides of a wellbore 114 (FIG. 1) as the hybrid drill bit 102 rotates downhole. In some exemplary embodiments, the fixed cutting elements 218 may include various types of polycrystalline diamond compact (PDC) cutter components or other ultra-hard materials.

A plurality of nozzle openings 222 are defined in the bit body 202 in one or more exemplary embodiments. Respective nozzles 224 may be disposed in each nozzle opening 222 for expelling various types of drilling fluid or mud 136 (FIG. 1) pumped through the drill string 118 (FIG. 1). The nozzle openings 222 are fluidly coupled to a fluid passageway (not shown) extending through the hybrid drill bit 102 to the drill string 118 (FIG. 1).

The rolling cutting blade 206 is supported within a slot 230 extending (defined) laterally across the bit body 202. The rolling cutter blade 206 is mounted within the slot 230 so that the rolling cutter blade 206 is able to rotate about a blade rotational axis $X_1$. The orientation of the blade rotational axis $X_1$ may vary, but as illustrated, the blade rotational axis $X_1$ is generally perpendicular to the bit body rotational axis $X_0$.

The rolling cutter blade 206 includes support disc 232 and a plurality of rotating cutting elements 234 supported around a periphery of the support disc 232. The support disc 232 may be constructed of steel or any of the materials described above for construction of the bit body 202. The rotating cutting elements 234 may be secured in a fixed position on the support disc 232 such that the rotating cutting elements 234 rotate with respect to the bit body 202 as the support disc 232 rotates. In some example embodiments, the rotating cutting elements 234 are PDC cutting elements similar to the fixed cutting elements 218. In other embodiments, the rotating cutting elements 234 may differ from the fixed cutting elements 218. For example, the rotating cutting elements 234 may exhibit different shapes or types of PDC cutters, or cutters constructed of hard or abrasive materials other than PDC.

As illustrated, the rolling cutter blade 206 rotates on an axle 238 (depicted in dashed lines in FIG. 2A) extending across the slot 230. Rotation of the rolling cutter blade 206 about the axle 238 is supported by axle bearings 242. The axle bearings 242 may include bearing sets 244 provided on both front 232*f* and rear 232*r* sides of the support disc 232. The axle bearings 242 may include any arrangement of open, sealed or shielded ball bearings to facilitate rotation of the rolling cutter blade 206 with respect to the bit body 202.

The rolling cutter blade 206 is secured in the bit body 202 by a blade holder 240. As illustrated, the blade holder 240 is a double sided pin projecting from both front 232*f* and rear 232*r* sides of the support disc 232 of the rolling cutter blade 206. The blade holder 240 may have hemispherical-shaped ends that are sized to be received within an indentation 246 defined in the bit body 202. The hemispherical shaped ends of the blade holder 240 may bear against the bit body 202 and allow for multi-axis rotation of the rolling cutter blade 206 as the rolling cutter blade 206 rotates in the direction of arrow 250 with respect to the bit body 202. This rotation distributes a wear load on the rotating cutting elements 234, thereby prolonging a service life of the drill bit 102. The blade holder 240 engages the indentation 246 in the bit body 202 and serves as a no-go shoulder preventing the rolling cutter blade 206 from being detached from the bit body 202.

As best seen in FIG. 2B, the blade rotational axis $X_1$ may be laterally offset from the body rotational axis $X_0$. Thus, rotation of the bit body 202 about the body rotational axis $X_0$ with the rolling cutting blade 206 in contact with the geologic formation "G" (FIG. 1) may induce rotation of the rolling cutting blade 206 around the blade rotational axis $X_1$ in the direction of arrow 250. As the rolling cutting blade 206 rotates, an exposed segment 206*e* of the rolling cutting blade 206 emerges from the slot 230 while concealed segments 206*c* on each adjacent side of the exposed segment 206*e* are disposed within the slot. In some embodiments, the exposed segment 206*e* may comprise about 20 percent or less of the entire circumference of the rolling cutting blade 206. Further rotation of the rolling cutting blade 206 conceals the exposed segment 206*e* in the slot and exposes a concealed segment 206*c*. In this manner, each of the rotating cutting elements 234 on an outer periphery of the rolling cutting blade 206 sequentially emerges from the slot 230 at the leading end 202*a* of the hybrid drill bit 102 where it is exposed to the geologic formation "G," and then rotates back into the slot 230.

Since each of the rotating cutting elements 234 is only exposed to the geologic formation "G" for a portion of the operational life of the hybrid drill bit 102, and since the hybrid drill bit 102 may include a greater number of cutting elements than a conventional fixed cutter drill bit (not shown), the operational life of the hybrid drill bit 102 may be longer than the conventional drill bit. Even if each of the fixed cutting elements 218 on hybrid drill bit 102 becomes worn, the rotating cutting elements 234 may continue to cut the geologic formation. The hybrid drill bit 102 may be especially useful in drilling in hard and abrasive geologic formations, where a conventional drill bit may become ineffective due to wear. Use of the hybrid drill bit 102 may allow an operator to penetrate further without performing a bit trip where the drill string 118 (FIG. 1) is removed from the wellbore 114, a new drill bit is attached to continue drilling.

Figure 3A:
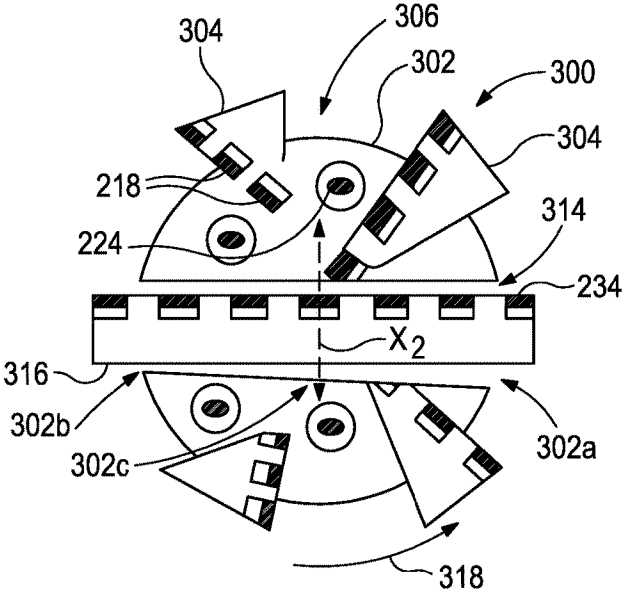
FIGS. 3A through 3C are top views of alternate embodiments of drill bits constructed in accordance with one or more exemplary embodiments of the disclosure, respectively illustrating a rolling PDC blade protruding from top and lateral sides of the bit body, a rolling PDC blade including PDC cutting elements supported on both front and reverse sides thereof and multiple rolling PDC blades supported on the bit body.

Referring to FIG. 3A, a top view of an alternate hybrid drill bit 300 with a bit body 302 is illustrated. The bit body 302 defines fixed cutting blades 304 supporting fixed cutting elements 218 thereon. Junk slots 306 are defined with nozzles 224 therein. The bit body 302 also defines a slot 314 extending therethrough. A rolling cutting blade 316 is supported within the slot 314 such that the rolling cutting blade 316 is free to rotate about a rotational bade axis $X_2$. Although not explicitly illustrated in FIG. 3A, the rolling cutting blade 316 may be supported by axle bearings 240 (FIG. 2A) and a blade holder (FIG. 2) as described above. The rolling cutting blade 306 protrudes from the slot 304 on first and second lateral sides 302*a*, 302*b* of the bit body 302, and in some embodiments, may also protrude from the slot 304 on a leading end 302*c* of the bit body 302. Rotating cutting elements 234 are supported around a periphery of the rolling cutting blade 316. In operation, rotating the hybrid drill bit 300 in the direction of arrow 318 may induce rotation of the rolling cutting blade 306 such that the rotational cutting elements 234 emerge sequentially from the slot 314 as the rolling cutting blade 316 rotates about the rotational blade axis $X_2$. The rotational cutting elements 234 may engage the geologic formation "G" (FIG. 1) on the first lateral side 302*a* and the leading end 302*c* to shear geologic material therefrom.

Figure 3B:
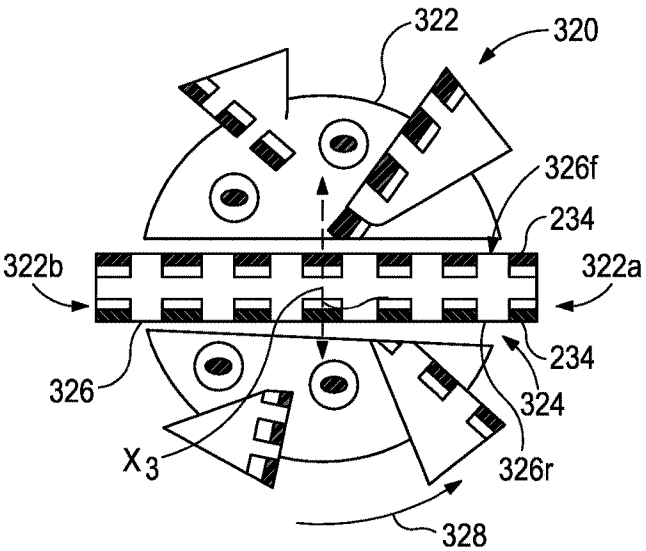

Referring to FIG. 3B, a top view of an alternate hybrid drill bit 320 is illustrated including a bit body 322 defining a slot 324 therethrough. A rolling cutting blade 326 is supported within the slot 324 such that the rolling cutting blade 326 is free to rotate about a rotational bade axis $X_3$. Although not explicitly illustrated in FIG. 3B the rolling cutting blade 326 may be supported by axle bearings 240 (FIG. 2A) and a blade holder (FIG. 2) as described above. The rolling cutting blade 326 supports rotating cutting elements 234 on both a front 326*f* and rear 326*r* side of the rolling cutting blade 326. The rotating cutting elements 234 on the front side 326*f* may sequentially emerge from the slot 324 to engage the geologic formation "G" on a first lateral side 322*a* of the bit body 322 and the rotating cutting elements 324 on the rear side 322*b* may sequentially emerge from the slot 324 to engage the geologic formation "G" on a second lateral side of the bit body 322 as the hybrid drill bit 320 rotates in the direction of arrow 328.

Figure 3C:
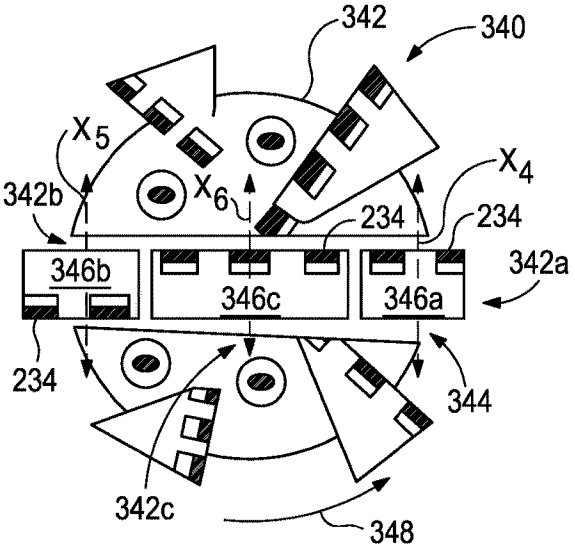

Referring to FIG. 3C, a top view of an alternate hybrid drill bit 340 is illustrated including a bit body 342 defining a slot 344 therethrough. Three rolling cutting blades 346*a*, 346*b* and 346*c* are supported within the slot 344 such that the rolling cutting blades 346*a*, 346*b*, 346*c* are free to rotate about a rotational blade axes $X_4$, $X_5$ and $X_6$, respectively. Although not explicitly illustrated in FIG. 3C, the rolling cutting blades 346*a*, 346*b* and 346*c* may each be supported by axle bearings 240 (FIG. 2A) and a blade holder (FIG. 2) as described above. The rolling cutting blade 346*a* includes rotating cutting elements 234 thereon, which may engage the geologic formation "G" (FIG. 1) on a first lateral side 342*a* of the bit body 342. Similarly, the rolling cutting blade 346*b* includes rotating cutting elements 234 thereon, which may engage the geologic formation "G" on a second lateral side 342*b* of the bit body, and the rolling cutting blade 326*c* includes rotating cutting elements 234 thereon, which may engage the geologic formation "G" on a leading end 342*c* of the bit body. Each of the three rolling cutting blades 346*a*, 346*b* and 346*c* may be induced to rotate around the respective axes $X_4$, $X_5$ and $X_6$, by rotating the hybrid drill bit 340 in the direction of arrow 348.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A drill bit for forming a wellbore through a geologic formation, the drill bit comprising:

a bit body defining a bit body rotational axis extending longitudinally therethrough;

a fixed cutting element mounted on the bit body for rotation with the bit body about the bit body rotational axis;

a slot defined in the bit body and extending entirely therethrough from a first lateral side that extends radially outward relative to the bit body rotational axis to a second lateral side that extends radially outward relative to the bit body rotational axis and opposite the first lateral side of the bit body;

a rolling cutting blade rotatably supported in the slot such that an exposed segment of the rolling cutting blade protrudes from the slot and concealed segments of the rolling cutting blade adjacent the exposed segment are disposed within the slot, the rolling cutting blade being supported to rotate about a blade rotational axis to thereby conceal the exposed segment and expose the concealed segments; and a plurality of rotating cutting elements supported on a periphery of the rolling cutting blade.

2. The drill bit of claim 1, wherein each of the fixed cutting elements and each of the rotating cutting elements are PDC cutting elements.

3. The drill bit of claim 2, wherein the exposed segment of the rolling cutting blade protrudes from the slot on a leading end of the bit body.

4. The drill bit of claim 3, wherein the exposed segment comprises less than about 20 percent of a circumference of the rolling cutting blade.

5. The drill bit of claim 1, wherein the rolling cutting blade is supported in the slot by a blade holder defining a no-go shoulder to retain the rolling cutting blade within the slot.

6. The drill bit of claim 1, wherein the exposed segment is defined on the first lateral side of the bit body.

7. The drill bit of claim 6, wherein the plurality of rotating cutting elements includes rotating cutting elements supported on both a front and a rear side of the rolling cutting blade.

8. The drill bit of claim 6, further comprising at least one additional rolling cutting blade supported in the slot on the second lateral side of the bit body.

9. The drill bit of claim 6, wherein the exposed segment protrudes laterally from the slot on first lateral side of the bit body.

10. The drill bit of claim 9, further comprising additional rolling cutting blade supported in the slot on the second lateral side of the bit body and protruding laterally from the slot on second lateral side of the bit body.

11. The drill bit of claim 10, wherein the rolling cutting blade includes rotating cutting elements supported on a front side of the rolling cutting blade and wherein the additional rolling cutting blade includes rotating cutting elements supported on a rear side of the additional rolling cutting blade.

12. The drill bit of claim 1, wherein the blade rotational axis is generally orthogonal to the bit body rotational axis and laterally offset from the bit body rotational axis such that rotation of the bit body about the bit body rotational axis induces rotation of the rolling cutting blade about the blade rotational axis.

13. A downhole drilling system, comprising:

a drill string extending into a wellbore penetrating a geologic formation;

a drill bit coupled to the drill string and providing a bit body that defines a bit body rotational axis extending longitudinally therethrough;

a slot defined in the bit body and extending entirely therethrough from a first lateral side that extends radially outward relative to the bit body rotational axis to a second lateral side that extends radially outward relative to the bit body rotational axis and opposite the first lateral side of the bit body;

a rolling cutting blade supported in the slot such that an exposed segment of the rolling cutting blade protrudes from the slot and concealed segments of the rolling cutting blade adjacent the exposed segment are disposed within the slot, the rolling cutting blade supported to rotate about a blade rotational axis to thereby conceal the exposed segment and expose the concealed segments; and a plurality of rotating cutting elements supported on a periphery of the rolling cutting blade.

14. The downhole drilling system of claim 13, further comprising a fixed cutting element mounted on the bit body for rotation with the bit body about the bit body rotational axis.

15. The downhole drilling system of claim 14, wherein each of the fixed cutting elements and each of the rotating cutting elements are PDC cutting elements.

16. The downhole drilling system of claim 13 wherein the rolling cutting blade is supported in the slot by a blade holder defining a no-go shoulder to retain the rolling cutting blade within the slot.

17. The downhole drilling system of claim 13, wherein the blade rotational axis is generally orthogonal to the bit body rotational axis and laterally offset from the bit body rotational axis such that rotation of the bit body about the bit body rotational axis induces rotation of the rolling cutting blade about the blade rotational axis.

18. The downhole drilling system of claim 13, further comprising a plurality of nozzles supported on the bit body, the plurality of nozzles fluidly coupled to the drill string.

* * * * *